United States Patent [19]

Spirig

[11] 4,086,586

[45] Apr. 25, 1978

[54] CLOSED SPACE INTEGRITY

[76] Inventor: Ernst Spirig, Movenstrasse 37, CH-8640 Rapperswil, Switzerland

[21] Appl. No.: 710,656

[22] Filed: Aug. 2, 1976

[51] Int. Cl.[2] ..... G08B 13/16

[52] U.S. Cl. ..... 340/258 B; 340/224; 343/5 PD

[58] Field of Search ..... 340/258 R, 258 B, 258 D, 340/224; 343/5 PD

[56] References Cited

U.S. PATENT DOCUMENTS

| | | | |
|---|---|---|---|
| 2,782,405 | 2/1957 | Weisz et al. | 340/276 |
| 3,065,455 | 11/1962 | Roth | 340/258 B |
| 3,513,463 | 5/1970 | Stevenson, Jr. et al. | 340/258 R |
| 3,659,289 | 4/1972 | Everitt | 340/416 |
| 3,721,972 | 3/1973 | Hermans | 340/276 |
| 3,938,118 | 2/1976 | Galvin et al. | 340/258 R |

*Primary Examiner*—John W. Caldwell, Sr.
*Assistant Examiner*—Joseph E. Nowicki
*Attorney, Agent, or Firm*—Lawrence E. Laubscher

[57] ABSTRACT

To supervise the integrity of an enclosed space one terminal of an ultrasonic transmission link is placed inside the space, and the other terminal outside, so that any breach of the walls enclosing the space causes an increase in the received ultrasonic intensity which initiates an alarm. The frequency used may be as low as 18 kHz. In an installation involving several supervised spaces, each space contains a receiver and a plurality of transmitters are outside all the spaces. Individual transmitters may emit coded radiation.

7 Claims, 2 Drawing Figures

CLOSED SPACE INTEGRITY

FIELD OF THE INVENTION

The invention relates to equipment for supervising the integrity of an enclosed space, the equipment including at least one transmitter and one receiver, which together constitute a transmission means, one of the elements of the transmission means being situated in the space to be supervised.

DESCRIPTION OF THE PRIOR ART

Arrangements for supervising the integrity of enclosed spaces by the use of ultrasonics are already known. One of these arrangements serves for the generation of an alarm signal on the breaking of a double glazed window having a closed intermediate space. This arrangement includes a generator for generating an alternating voltage in the ultrasonic range, an ultrasonic transmitter, at least one ultrasonic receiver connected to a selective amplifier and a device for generating an alarm signal. The ultrasonic transmitter mentioned is arranged in the intermediate space of the double-glazed window, the ultrasonic receiver being situated in the supervised space. If the glass plate separating the ultrasonic transmitter from the ultrasonic receiver is damaged, then a part of the ultrasonic energy radiated from the ultrasonic transmitter emerges from the intermediate space and passes to the ultrasonic receiver in the supervised space. The increase in the signal in the ultrasonic receiver is then passed on through the selective amplifier to the alarm device, which initiates an alarm.

A first disadvantage of this known arrangement depends on the fact that only the condition of the double-glazed window is supervised, so that intrusion into the supervised space for example by breaking upon the door, or one of the walls, or the floor or the ceiling cannot be signalled by this arrangement. A further disadvantage of this known arrangement can be seen in that only a single closed space can be supervised. In order to carry out overall supervision of individual dwelling units, or of whole dwelling or apartment houses and similar objects, a high cost would be necessary with this known arrangement.

This arrangement for the double glazed windows has never been used in practice.

Other ultrasonic intruder detection systems are known. All these known ultrasonic detector systems employ the so called Doppler effect on ultrasonic waves. An ultrasonic transmitter and receiver are placed in the same closed space. Any moving object within the range of the transmitter and receiver area causes a Doppler shift, which means that the received ultrasonic frequency is slightly different from the emitted frequency. The very big disadvantage of this very popular Doppler technique is that the detected Doppler shift can be caused by motion of air, of fan blades, drafts from ventilators and airconditioners or drafts caused by heaters. If the Doppler alarm is sufficiently sensitive for dependable protection against intruders, then there is the chance that the alarm will be triggered by such sources and not by a real intruder. False alarms are the worst and least wanted thing in an alarm system. It is known to use compensation and filter networks in Doppler intruder detection systems, but as frequencies of disturbance caused by shifts and of real body moving are overlapping, false alarms can never be eliminated.

This is specially critical if larger areas are to be covered and supervised with the Doppler ultrasonic alarm system.

To obtain full coverage of an extended area by the use of the known Doppler ultrasonic alarm systems it is necessary to use a sensitive receiver which is very liable to false alarms.

The present invention is based on response to the intensity of the received sound. The disturbances of the kind mentioned above do not increase the intensity of the sound level. The present invention is free of false alarms as one of the most important factors. The invention provides full coverage of the space without any possibility of false alarm.

It is an object of the invention to provide an arrangement for supervising the integrity of an enclosed space by the use of supersonics that overcome disadvantages of known arrangements, namely, liability to false alarms.

It is a further object of the invention to provide supersonic enclosed space supervisory equipment enabling supervision of a plurality of enclosed spaces.

It is an additional object of the invention to provide enclosed space integrity supervising equipment useful in multiple use dwellings.

In an embodiment of the invention a space to be supervised is wholly enclosed by barriers impeding the transmission of ultrasonic radiation. Within the space is arranged one terminal of an ultrasonic transmission equipment including an ultrasonic receiver and an ultrasonic transmitter. The ultrasonic transmitter is supplied with an ultrasonic voltage and, in response to ultrasonic radiation from the transmitter received through the barriers, the ultrasonic receiver develops a signal representative of the intensity of the received radiation. The signal developed by the ultrasonic receiver is applied to an evaluating circuit which is arranged, in response to a substantial increase in the received intensity, to generate an alarm signal denoting that the integrity of the supervised space has been breached.

Other disturbances influencing Doppler alarms are ultrasonic sound generating sources like bells, sonic booms, lightning. Embodiments of the present invention can easily distinguish between such noise level increasing disturbances in cases where they have the same frequency. The transmitter may emit coded signals, e.g., ultrasonic sound pulses repetitive at frequencies of e.g. 100 cycles or one kilocycle. Such a flow of pulses would have to be present for a predetermined period of 1, 3 or 5 seconds controlled by a timer in the receiver, before an alarm response is developed.

DESCRIPTION OF THE PREFERRED EMBODIMENTS

Figure 1:
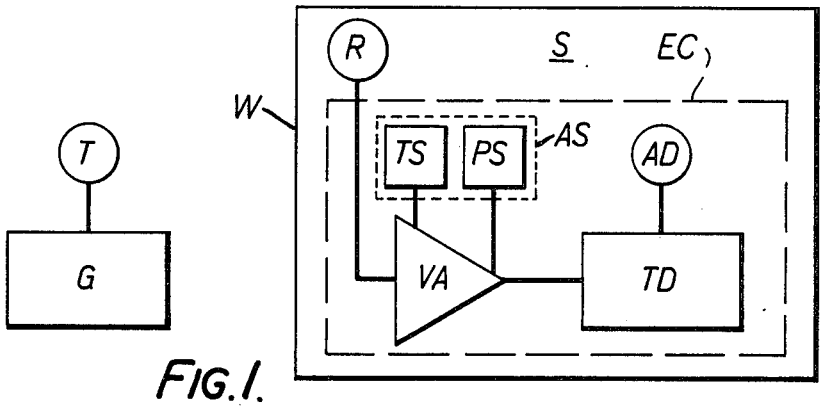
FIG. 1 is a schematic diagram used to explain the principle of the invention.

An embodiment of the invention for supervising the integrity of a single enclosed space will now be described with reference to FIG. 1 of the drawing. An enclosed space S bounded by walls or barriers W that attenuate ultrasonic radiation contains an ultrasonic receiver R. Outside the barriers W is disposed an ultrasonic transmitter T that is energized by a generator G generating an output voltage at an ultrasonic frequency. The term "ultrasonic" is used herein to denote not only frequencies above 20 kHz and thus inaudible to all, but also very high "audio" frequencies, in the range from about 18 kHz to 20 kHz, that can be heard by some few. The output voltage of generator G is applied to ultrasonic transmitter T that accordingly radiates ultrasonic radiation. Some of this radiation passes into space S through barriers W by which it is substantially attenuated and energizes ultrasonic receiver R. Receiver R develops an output signal representative of the intensity of the received ultrasonic radiation and this signal is applied to an evaluating circuit EC. Evaluating circuit includes a known threshold device TD yielding an output signal when an applied input signal exceeds a predetermined threshold level. The threshold level at which evaluating circuit EC yields an output signal is chosen to be higher than the level of the signal applied to the threshold device TD when the integrity of the supervised space is complete, but low enough that the increase in ultrasonic intensity reaching receiver R as a result of any breach in the integrity of the barriers enclosing the supervised space will yield an output signal. The output signal from the threshold device is applied to initiate the operation of an alarm device AD which may be of any known kind suited to the particular application. Evaluating circuit EC may advantageously also comprise a variable-gain amplifier VA through which the signal received from ultrasonic detector R is amplified before application to threshold device TD. The gain of amplifier VA may be arranged to be controlled by air sensor means AS, responsive to the condition of the ambient air, in such a manner as to compensate for variations in propagation characteristics of the air with varying climatic conditions. Thus air sensor means AS may include thermally sensitive means TS yielding a first gain-control signal varying in accordance with air temperature and also pressure-sensitive means PS yielding a second gain-control signal varying in accordance with the barometric pressure. Preferably the individual response characteristics of the respective thermal and pressure sensitive means TS, PS and the response of the air sensor means AS to the signals provided by these are such that the gain control signal provided by the air sensor means as a result of changes in the ultrasonic transmission of the air represents a worst-case response to said changes.

A further sensing means (not shown) may be arranged to yield a third gain-control signal varying in accordance with atmospheric humidity.

The physical behaviour of ultrasonic frequencies in respect to temperature, pressure, humidity and other transmission influencing factors are well explored.

Transmission intensity can be chosen to a level where any leak caused by an intruder in the wall may increase the receiver signal much more (10 times eg) than the physical influence from temperature etc.

The several gain control signals are applied to vary appropriately the gain of amplifier VA. By this means it may be arranged that false alarms or alarm failures due to changes in atmospheric propagation of the radiated ultrasonic signals are avoided.

It is advantageous for the threshold device to be arranged also to yield an output signal in the event of the received ultrasonic energy falling substantially below the normally received level, so as to yield an indication that the system is defective in the event of failure of a transmitting or receiving transducer by inherent defect or sabotage.

Figure 2:
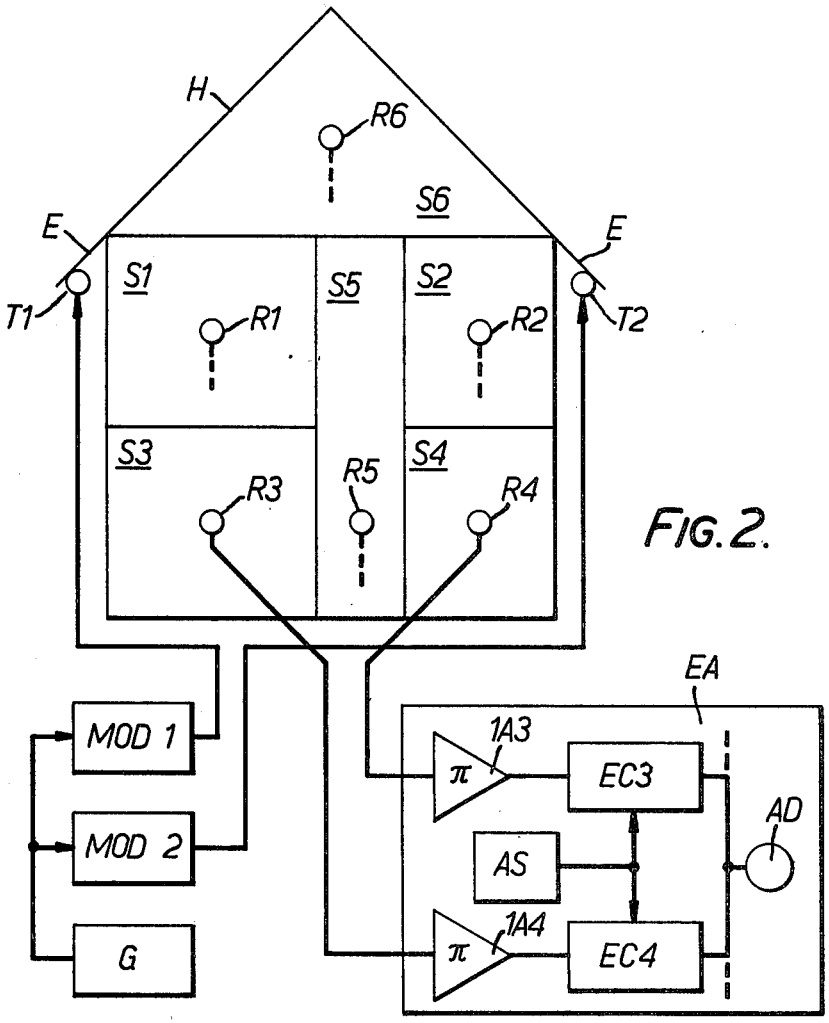
FIG. 2 is a schematic diagram used to explain the application of the invention in a multiple-use dwelling.

In FIG. 2 of the drawing there is shown a simple dwelling house H of which the integrity of certain spaces is to be supervised. This dwelling house is subdivided into several individually enclosed spaces S1-S6. Outside the enclosed spaces S1-S6 are arranged two ultrasonic transmitters T1, T2, advantageously secured to the eaves E of the house, as shown. Each of spaces S1-S6 contains an individual ultrasonic receiver R1-R6 respectively, each of which is coupled to a central evaluating apparatus EA. This apparatus contains in respect of each receiver R1-R6 a respective isolating amplifier 1A1-1A6 of which only 1A3 and 1A4 are shown, all the remainder being connected similarly, the outputs of each of isolating amplifiers being applied to a respective evaluating circuit EC1-EC6 corresponding with evaluating circuit EC described in relation to FIG. 1. Isolating amplifiers IA1-IA6 have individually presettable gains so that the normal signal from each receiver may be arranged to yield at the input of the respective variable gain amplifier a signal of which the amplitude is appropriately lower than the threshold level of the respective evaluating circuit EC1-6. Thus all of the variable gain amplifiers included in the evaluating circuits EC1-EC6 may be controlled identically by an air sensor means AS common to all the evaluating circuits. The evaluating circuits EC1-EC6 will in response to an input signal exceeding a preset threshold line also usually energize a common alarm device AD and may also energize a respective individual alarm to denote the space of which the integrity has been breached.

Each of ultrasonic transmitters T1, T2 may be advantageously fed from a common ultrasonic generator G by way of a respective modulator MOD1, MOD2, which yield respective distinctively modulated signals. The evaluating circuits EC1-EC6 are then arranged to respond selectively to signals from the respective mist adjacent transmitters so that an increase in a signal received from the other transmitter as a result of an authorized breach of integrity elsewhere in the building will not yield an unnecessary alarm.

Each receiver R1 to R6 may alternatively contain individually the signal conditioning electronics, so each receiver output is a simple relay change over contact which then can be wired into a loop of a known type of central alarm control panel. The supply of the power to the receiver and the transmitters can be provided centrally from the control panel. Each transmitter T1, T2 may alternatively contain the full electronics to generate a respective ultrasonic pattern.

It will be understood that there have been described arrangements readily fulfilling the principal object of the invention, that is to provide an ultrasonic alarm system which does not have the disadvantage of the known ultrasonic alarm systems, namely false alarms.

What is claimed is:

1. In closed space integrity supervision equipment for supervising the integrity of a space enclosed by sonically attenuating enclosure means, said equipment including ultrasonic transducers of which one is energized to transmit ultrasonic energy and another is arranged to develop an electric signal as a function of the intensity of received ultrasonic energy, one of said ultrasonic transducers being disposed within said space and the other of said ultrasonic transducers outside said space, whereby ultrasonic energy transmitted between said transducers is attenuated in passing through said enclosure means, and signal processing means responsive to predetermined increase in said electric signal to yield an output signal as a function of a breach in the integrity of said space; the improvement wherein said signal processing means includes:

(a) variable gain amplifier means coupled with said receiving transducer for amplifying said electric signal, thereby to produce an amplified signal;

(b) a threshold device coupled with said variable gain amplifier means for producing from said amplified signal said output signal in response to a received signal in excess of a predetermined amplitide; and (c) air sensor means responsive to a physical characteristic of the ambient air for producing a gain-control signal, and means coupling said gain control signal with said amplifier means to control the gain thereof, thereby to compensate for variations in sonic transmission resulting from changes in said air characteristic.

2. The invention claimed in claim 1, wherein said threshold device yields an output signal also in response to said amplified signal falling below a further predetermined amplitude.

3. The invention claimed in claim 1, wherein said air sensor means includes a plurality of sensors each responsive to a respective different air characteristic, each of said sensors having a respective response characteristic such that said air sensor means provides a gain-control signal representing a worst-case response to changes in the ultrasonic transmission characteristics of the air.

4. In closed-space integrity supervision equipment for supervising the integrity of a plurality of spaces individually enclosed by sonically attenuating enclosure means, said equipment including a plurality of ultrasonic transducer means between which ultrasonic energy is transmitted, whereby at least one said transducer means develops an electric signal as a function of the intensity of ultrasonic energy received thereby, and signal processing means responsive to predetermined variation in said electric signal to develop an output signal as a function of a breach in the integrity of a said space, the improvement comprising:

(a) a first set of said ultrasonic transducer means, said first set comprising an ultrasonic transducer means disposed within each said space;

(b) a second set of said ultrasonic transducer means, said second set comprising at least one said ultrasonic transducer means disposed outside all of said spaces; and (c) ultrasonic generator means coupled to apply ultrasonic signals to the ultrasonic transducer means of one said set to cause the radiation of ultrasonic energy by said ultrasonic transducer means of said one set, whereby the ultrasonic transducer means of the other set generate respective electric signals as a function of the intensity of ultrasonic energy individually received thereby;

(d) said signal processing means being responsive to a predetermined increase in any said respective electric signal to yield said output signal, said signal processing means including (1) a variable gain amplifier means for each said electric signal;

(2) a threshold device coupled to each variable gain amplifier means for producing an alarm signal in response to a received said electric signal in excess of a predetermined amplitude; and (3) air sensor means responsive to a characteristic of the ambient air for producing a gain-control signal, and means coupling said gain control signal to control the gain of said amplifier means, thereby to compensate for variations in sonic transmission resulting from changes in said air characteristic.

5. The invention claimed in claim 4, wherein the ultrasonic transducer means of said second set are fed with said ultrasonic signals and said ultrasonic transducer means of said first set are individually coupled to said signal processing means, respectively, whereby a breach of the integrity of any one of said spaces causes said output signal to be developed.

6. The invention claimed in claim 5, wherein each ultrasonic transducer means in said second set is fed with individual ones of said ultrasonic signals, respectively, thereby to radiate identified ultrasonic energy, respectively, said respective signal processing means being selectively responsive to said electric signals generated by said ultrasonic transducer means of said first set in response to ultrasonic energy radiated by an individual respective one of said ultrasonic transducer means of said second set.

7. The invention claimed in claim 4, wherein said signal processing means yields an output signal also in response to said electric signal denoting that ultrasonic energy received by a said ultrasonic transducer has fallen below a predetermined intensity.

* * * * *